US006057075A

United States Patent [19]

Yuh et al.

[11] Patent Number: 6,057,075

[45] Date of Patent: May 2, 2000

[54] PHOTORECEPTOR FABRICATION METHOD INVOLVING A TUNABLE CHARGE GENERATING DISPERSION

[75] Inventors: Huoy-Jen Yuh, Pittsford; Cindy C. Chen, Rochester; Rachael A. Forgit, Rochester; John S. Chambers, Rochester, all of N.Y.

[73] Assignee: Xerox Corporation, Stamford, Conn.

[21] Appl. No.: 09/132,730

[22] Filed: Aug. 12, 1998

[51] Int. Cl.[7] ..... G03G 5/04

[52] U.S. Cl. ..... 430/135

[58] Field of Search ..... 430/129, 96, 135

[56] References Cited

U.S. PATENT DOCUMENTS

| | | | |
|---|---|---|---|
| 5,322,755 | 6/1994 | Allen et al. | 430/96 |
| 5,324,615 | 6/1994 | Stegbauer et al. | 430/132 |
| 5,393,629 | 2/1995 | Nukada et al. | 430/76 |
| 5,418,099 | 5/1995 | Mayama et al. | 430/58 |
| 5,418,107 | 5/1995 | Nealey et al. | 430/132 |
| 5,571,647 | 11/1996 | Mishra et al. | 430/96 |
| 5,686,213 | 11/1997 | Cosgrove et al. | 430/56 |

*Primary Examiner*—John Goodrow
*Attorney, Agent, or Firm*—Zosan S. Soong

[57] ABSTRACT

A method for fabricating a photoreceptor including: (a) preparing a first stable coating dispersion including a solvent, a first polymer, and a charge generating material; and (b) diluting the concentration of the charge generating material by adding an amount of a second polymer to the first stable coating dispersion without losing the dispersion stability thereof, thereby resulting in a second stable coating dispersion.

11 Claims, No Drawings

PHOTORECEPTOR FABRICATION METHOD INVOLVING A TUNABLE CHARGE GENERATING DISPERSION

FIELD OF THE INVENTION

This invention relates to a photoreceptor fabrication method and in particular to the preparation of a tunable charge generating composition and its deposition onto a substrate. The term tunable refers to the capability of the charge generating composition to have a stable dispersion quality over a range of solid contents and over a range of charge generating material to binder ratios that provide a range of sensitivities for a photoreceptor.

BACKGROUND OF THE INVENTION

Electrophotographic imaging members may be in the form of plates, drums or flexible belts. These electrophotographic members are usually multilayered photoreceptors that include a substrate, a conductive layer, an optional hole blocking layer, an optional adhesive layer, a charge generating layer, and a charge transport layer, an optional overcoating layer and, in some belt embodiments, an anti-curl backing layer.

Due to differing electrical response requirements for different photoreceptors, companies have conventionally developed formulations for the charge generating layer using a variety of charge generating materials, binders, and solvents. The cost to develop new charge generating compositions using different sets of materials and the implementation of these new charge generating compositions into production increase the photoreceptor unit manufacturing cost. There is a need, which the present invention addresses, for a new photoreceptor fabrication method where a different electrical response requirement for a photoreceptor can be accommodated by adjusting one set of materials for the charge generating composition without losing the dispersion stability thereof. Thus, the present invention allows for a number of different charge coating compositions to be developed from one set of materials, thereby saving money in development costs and materials investment, as well as providing faster delivery of specific photoreceptors.

Photoreceptor coating compositions and methods for making them are disclosed in Cosgrove et al., U.S. Pat. No. 5,686,213; Nealey et al., U.S. Pat. No. 5,418,107; Stegbauer et al., U.S. Pat. No. 5,324,615; Nukada et al., U.S. Pat. No. 5,393,629; and Mayama et al., U.S. Pat. No. 5,418,099.

BUTVAR® resins are described in a five page brochure from Monsanto Chemical Company, the disclosure of which is totally incorporated herein by reference.

A Type V hydroxygallium phthalocyanine is described in Katsumi Daimon et al., "A New Polymorph of HydroxyGallium Phthalocyanine and its Application for Photoreceptor," Proceedings: IS&T's Tenth International Congress on Advances in Non-Impact Printing Technologies, pp. 215–219 (1994).

SUMMARY OF THE INVENTION

The present invention is accomplished in embodiments by providing a method for fabricating a photoreceptor comprising:

(a) preparing a first stable coating dispersion including a solvent, a first polymer, and a charge generating material; and (b) diluting the concentration of the charge generating material by adding an amount of a second polymer to the first stable coating dispersion without losing the dispersion stability thereof, thereby resulting in a second stable coating dispersion.

DETAILED DESCRIPTION

Using the process of the present invention, a number of photoreceptors may be fabricated using a common set of materials for the charge generating composition where the solids content or the material ratios in the charge generating composition can be adjusted to provide different electrical response characteristics among the photoreceptors. The electrical response characteristics include sensitivity range and light intensity. The present invention can provide photoreceptors with a specifically-tuned photo-induced discharge curve by diluting the concentration of the charge generating material (also referred herein as pigment) during the fabrication of the photoreceptor, rather than by redesigning the photoreceptor structure or by providing different chemical components for the various photoreceptor layers.

In general, to form photoreceptors, a substrate surface is coated with a blocking layer (optional), a charge generating layer, and a charge transport layer. Optional adhesive undercoating, overcoating and anti-curl layers also may be included, as desired. Alternatively, a single photoconductive layer may be applied to the substrate. If desired, the sequence of the application of coatings of multi-layered photoreceptors can be varied. Thus, a charge transport layer may be applied prior to the charge generating layer, or a charge generating layer may be applied prior to the charge transport layer. The photoconductive coating generally may be homogeneous and typically contains organic or inorganic photoconductive particles dispersed in a film-forming binder.

Generally, the electrical response characteristics of the photoreceptor are approximately directly related to the charge generating material to binder ratio in the charge generating composition, when other factors (such as photoreceptor construction) are held constant. This relationship is followed only when the charge generator pigments are uniformly dispersed in the charge generating layer without flocculation. That is, it has been found that as the charge generating material to binder ratio increases, the sensitivity (dV/dX, the surface voltage change after the photoreceptor is exposed to a certain amount of light, measured in V-cm$^2$/erg at a given photoreceptor surface voltage $V_0$) increases. Similarly, it has been found that as the charge generating material to binder ratio increases, the light intensity required to discharge the surface charged photoreceptor to a certain voltage, $V_{image}$ (X, measured in erg/cm$^2$ at $V_{image}$) decreases. Thus, by selecting a charge generating material to binder ratio based on the desired sensitivity and light intensity, a photoreceptor with a specifically desired photo-induced discharge curve may be provided. If the photogenerator pigments flocculate in the charge generating layer, domains form. At low pigment to binder ratio, large space between these domains in the charge generating layer makes charge transport through the generating layer very difficult. Charges can trapped in these domains to create lower than desired sensitivity. Only at high pigment to binder ratio is the space between the domains small enough to allow charge transport through the generating layer. Therefore, with flocculated charge generating layer coated from an unstable dispersion, only the high pigment to binder ratio generally can be used for the electrophotographic imaging process. In contrast, the photogenerated charges transport easily through the pigments in the charge generating layer into the charge transport layer when the charge generating layer is prepared from a stable dispersion.

In embodiments of the present invention, the photoreceptor preferably has a desired sensitivity and a desired light intensity such that the photoreceptor is capable of use in standard electrostatographic imaging processes. In particular, it is preferred that the photoreceptor has a sensitivity of from about 30 to about 400 V-cm$^2$/erg at a $V_{ddp}$ of 600 V on a photoreceptor of 20 micrometers thickness, more preferably from about 50 to about 300 V-cm$^2$/erg. It is also preferred that the photoreceptor has a light sensitivity of from about 1 to about 30 erg/cm$^2$ at 100 V, and more preferably from about 1.5 to about 20 erg/cm$^2$. According to the present invention, such electrical response characteristics may be readily obtained based on the relationship of the characteristics to the charge generating material to binder ratio in the charge generating layer.

In preparing the stable coating dispersion of the charge generating composition, milling may be employed. The dispersion milling may be conducted using any suitable milling equipment. For example, the milling may be conducted in such equipment as a jar mill, a ball mill, an attritor, a sand mill, a paint shaker, a dyno-mill, or a drum tumbler. Such equipment should also include a suitable grinding media of, for example, round, spherical or cylindrical grinding beads of steel balls, ceramic cylinders, glass balls, round agates or stones.

As discussed herein, a number of stable coating dispersions can be prepared from the first stable coating dispersion. For example, a second stable coating dispersion can be created by adding an amount of the same or different polymer to the first stable coating dispersion. A third stable coating dispersion can be created by adding another amount of the same or different polymer to the second stable coating dispersion. A fourth stable coating dispersion can be created by adding a dissimilar amount of the same or different polymer to the first stable coating dispersion. Each of the various coating dispersions described herein can be deposited onto a substrate during the fabrication of photoreceptors. In each situation described herein, the same or different polymer can be added to the coating dispersion either alone or in a solution including the same or different solvent(s) as in the first stable coating dispersion.

Additional binder can be added to a stable coating dispersion of the charge generating composition without losing the dispersion stability thereof, thereby resulting in another coating dispersion which is also stable and has a lower charge generating material to binder ratio. It is understood that the dispersion stability can decrease after addition of the additional binder amount, but that the dispersion quality of the resulting charge generating composition still falls within the range deemed stable as described herein. A dispersion is considered stable when the extent of aggregation between pigment particles does not show measured change over a time period such as a month or even a year. The stability of a dispersion depends upon the relative difference between the pigment-pigment force of attraction (van der Waals force) over the force of repulsion from the polymeric layer surrounding the pigment particles. The repulsive force depends on the thickness of the polymeric layer around the pigment particles and the charges on the surface of the pigment particles. Stability of a dispersion can be evaluated by measuring viscosity over time.

The term stable refers to the situation when the dispersion will not either flocculate with time or break down into other smaller forms under shear stress. This two effects can be easily monitered by rheological measurements in a standard rheometer. The rheological data can be fitted with the Herschel-Bulkley equation:

$$Tau=Tau_0+m^*(D)^P$$

where

P is greater than or equal to 0,

D=Shear rate;

Tau=shear stress;

$Tau_0$=Yield point, which represents the minimum stress required to initiate flow of the dispersion; and m* is a parameter obtained from fitting the shear stress data vs. shear rate.

If the dispersion does not flocculate with time, then the Theological data of this dispersion can easily be fitted into a simplified Power law equation:

$$Tau=m^*(D)^P$$

where Tau, m*, D, and P have the meanings described herein. The smaller the change happens in dispersion upon shearing, the closer the value of P in the above equation is to one. If the dispersion does not break down or deform with applied shear stress, then the rheological data can easily be fitted with a Newtonian equation which is similar to Power Law equation with P=1. Therefore, in embodiments, a stable dispersion means the rheological properties of the dispersion, at a solids content equal or larger than about 2 weight %, shows no yield point with P value equal or larger than about 0.8 and the viscosity value equal or larger than about 4 centipoise ("cp") at $1^{-1}$ sec shear rate.

Dispersion stability can be enhanced by selecting the components of the charge generating composition to have particular characteristics. The strength of the adsorption of the binder to the surface of the pigment particles and the viscosity of the coating dispersion are the key parameters to be adjusted. The coating dispersion viscosity depends on the chemical structure and molecular weight of the binder and the solvent viscosity. The higher the coating dispersion viscosity, the slower the dispersion settles, and therefore, the more stable the coating dispersion. The higher the binder molecular weight, the higher the coating dispersion viscosity, which means a more stable coating dispersion. Preferably, the solvent has a viscosity greater than about 1.5 centipose. In the first stable coating dispersion, prior to addition of the second polymer, the solids content (charge generating material and binder) may be up to and including about 15% by weight and the pigment to binder ratio may be about 80 (pigment): 20 (binder) by weight. After addition of the second polymer to form the second stable coating dispersion, the solids content may be reduced to a level ranging for example from about 2% to about 8% by weight and the pigment to binder ratio may be reduced to as low as about 30 (pigment):70 (binder) by weight.

The dispersion of high pigment to binder ratio is prepared by dissolving the polymer in the solvent first, then adding the pigment into the polymer solution. Milling media, such as glass beads or sand, are then mixed into the pigment and polymer solution mixture. The mixture is then milled by any conventional milling equipment, such as ball milling, an attritor or a dyno-mill. The proper amount of the polymer solution is then added into the stable dispersion of high pigment content to lower the pigment to binder ratio. Because the dispersion is stable, no additional milling is required after the addition of the polymer solution. Only low shear stirring is needed. As shown in the Examples, the first coating dispersion, called the millbase, at high pigment to binder ratio and at high total solids content, is prepared first. Then polymer solution is added into the millbase to prepare coating dispersions of lower pigment to binder ratio and lower total solids content.

The first and second polymers preferably have the following general formula:

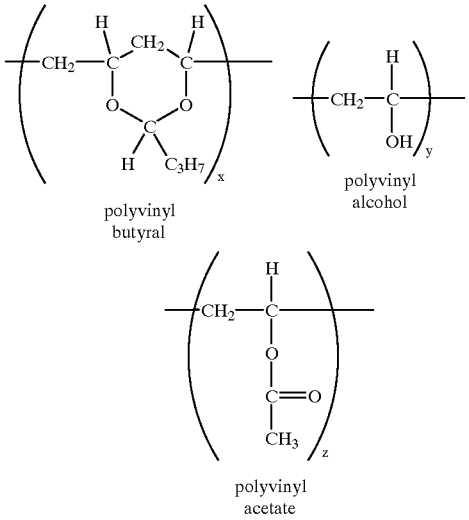

wherein x is a number such that the polyvinyl butyral moiety content ranges for example from about 75% to about 83% by weight, preferably about 80% by weight, based on the weight of the polymer;

wherein y is a number such that the polyvinyl alcohol moiety content (as explained herein these values also represent the hydroxyl content) is for example at least about 17% by weight, preferably from about 17.5% to about 20% by weight, based on the weight of the polymer; and wherein z is a number such that the polyvinyl acetate moiety content ranges for example from 0 to about 8% by weight, preferably from 0 to about 2.5% by weight, based on the weight of the polymer. The first and second polymers preferably have a molecular weight (weight average) of at least about 90,000, and preferably ranges from about 90,000 to about 250,000. The first polymer may be the same or different material from the second polymer in terms of chemical structure, molecular weight, or percentage of various moieties. The first and second polymers may be present in each coating composition in an amount ranging for example from about 1% to about 8% by weight, based on the weight of the coating composition.

Polymers of the type described above are available from Monsanto Chemical Company as BUTVAR® resins. Preferred BUTVARs resins and their properties are identified in the following Table 1:

| Property | ASTM Method | B-72 | B-74 | B-73 | B-90 |
|---|---|---|---|---|---|
| Molecular wt. (weight average in thousands) | (1) | 170–250 | 120–150 | 90–120 | 70–100 |
| *Hydroxyl content expressed as % polyvinyl alcohol | | 17.5–20.0 | 17.5–20.0 | 17.5–20.0 | 18.0–20.0 |

-continued

| Property | ASTM Method | B-72 | B-74 | B-73 | B-90 |
|---|---|---|---|---|---|
| Acetate content expressed as % polyvinyl acetate | | 0–2.5 | 0–2.5 | 0–2.5 | 0–1.5 |
| Butyral content expressed as % polyvmyl butyral, approx. | | 80 | 80 | 80 | 80 |

*Specification properties.

All properties were determined by ASTM methods except the following: (1) Molecular weight was determined via size exclusion chromatography with low-angle laser light scattering (SEC/LALLS) method of Cotts and Ouano in tetrahydrofuran. P. Dublin, ed., Microdomains in Polymer Solutions (New York: Plenum Press, 1985), pp. 101–119.

Sekisui Chemical Company sells a binder compound BM-S™ having a weight average of molecular weight of about 93,000 and composed of polyvinyl butyral moiety (believed to about 88% by weight based on the weight of the binder), a polyvinyl alcohol moiety, and a polyvinyl acetate moiety, where the polyvinyl alcohol moiety has a hydroxyl content believed to be about 8.7% by weight expressed as a percentage by weight of the polyvinyl alcohol moiety based on the weight of the binder.

Other binders may be used for the first polymer and the second polymer such as polyester, polystyrene, polyvinyl pyrrolidone, methyl cellulose, polyacrylates, cellulose esters, and the like.

The solvent can be for example cyclohexanone alone or in a mixture with one or more other solvents. The amount of cyclohexanone in the solvent may be for example at least 50% by volume, preferably 100% by volume, based on the total volume of the solvent. One or more other solvents can be added to cyclohexanone such as methyl ethyl ketone, tetrahydrofuran, and alkyl acetate. An alkyl acetate (such as butyl acetate and amyl acetate) having from 3 to 5 carbon atoms in the alkyl group may be present in the solvent in an amount ranging from 0% to about 50% by volume, based on the volume of the solvent. The amount of solvent in each coating composition ranges for example from about 85% to about 98% by weight, based on the weight of the coating composition. Other solvents that can be used alone or in a mixture include glycol, ether, and alcohols such as methanol and ethanol.

The charge generating material is preferably an organic compound such as a phthalocyanine compound. Suitable phthalocyanine compounds (also referred herein as photoconductive particles) for the present coating composition include, for example, metal-free phthalocyanine including the X-form of metal free phthalocyanine described in U.S. Pat. No. 3,357,989, metal phthalocyanines such as copper phthalocyanine; titanyl phthalocyanines including various polymorphs identifiable by characteristic diffraction spectrums obtained with characteristic x-rays of Cu Ka at a wavelength of 1.54 Angstrom such as those having an intense major diffraction peak at a Bragg angle (2θ±0.2°) of 27.3 and other peaks at about 9.34, 9.54, 9.72, 11.7, 14.99, 23.55, and 24.13 (referred to as Type IV), those having an intense major diffraction peak at a Bragg angle (2θ±0.2°) of 26.3 and other peaks at about 9.3, 10.6, 13.2, 15.1, 20.8, 23.3, and 27.1 (referred to as Type I); an improved version of Type I described in Trevor I. Martin et al., U.S. Pat. No.

5,350,844, the entire disclosure of which is incorporated herein by reference; those having an intense major diffraction peak at a Bragg angle (2θ±0.2°) of 28.6 and other peaks at about 8.6, 12.6, 15.1 18.3, 23.5, 24.2, and 25.3 (referred to as Type II); chloroindium phthalocyanine; chlorogallium phthalocyanine, hydroxygallium phthalocyanine, and the like. A preferred phthalocyanine compound is Type V hydroxygallium phthalocyanine such as that described in Katsumi Daimon et al., "A New Polymorph of HydroxyGallium Phthalocyanine and its Application for Photoreceptor," Proceedings: IS&T's Tenth International Congress on Advances in Non-Impact Printing Technologies, pp. 215–219 (1994), the disclosure of which is totally incorporated herein by reference. Mixtures of two or more charge generating materials may be used. For the sake of convenience, Type I titanyl phthalocyanine and the improved version of Type I described in Trevor I. Martin et al., U.S. Pat. No. 5,350,844 are both referred to herein as Type I titanyl phthalocyanine. Preferably, the photoconductive particles are substantially insoluble in the solvent employed to dissolve the film forming binder.

Other suitable charge generating materials may be for example azo pigments such as Sudan Red, Dian Blue, Janus Green B, and the like; quinone pigments such as Algol Yellow, Pyrene Quinone, Indanthrene Brilliant Violet RRP, and the like; quinocyanine pigments; perylene pigments; indigo pigments such as indigo, thioindigo, and the like; bisbenzoimidazole pigments such as Indofast Orange toner, and the like; quinacridone pigments; or azulene compounds.

The amount of the charge generating material in each coating composition ranges for example from about 0.5% to about 5% by weight, based on the weight of the coating composition. The amount of photoconductive particles dispersed in a dried photoconductive coating varies to some extent with the specific photoconductive pigment particles selected. For example, when phthalocyanine organic pigments such as titanyl phthalocyanine and metal-free phthalocyanine are utilized, satisfactory results are achieved when the dried photoconductive coating comprises between about 50 percent by weight and about 90 percent by weight of all phthalocyanine pigments based on the total weight of the dried photoconductive coating. Since the photoconductive characteristics are affected by the relative amount of pigment per square centimeter coated, a lower pigment loading may be utilized if the dried photoconductive coating layer is thicker. Conversely, higher pigment loadings are desirable where the dried photoconductive layer is to be thinner.

Generally, satisfactory results are achieved with an average photoconductive particle size of less than about 0.6 micrometer when the photoconductive coating is applied by dip coating. Preferably, the average photoconductive particle size is less than about 0.4 micrometer. Preferably, the photoconductive particle size is also less than the thickness of the dried photoconductive coating in which it is dispersed.

For multilayered photoreceptors comprising a charge generating layer (also referred herein as a photoconductive layer) and a charge transport layer, satisfactory results may be achieved with a dried photoconductive layer coating thickness of between about 0.1 micrometer and about 10 micrometers. Preferably, the photoconductive layer thickness is between about 0.2 micrometer and about 4 micrometers. However, these thicknesses also depend upon the pigment loading. Thus, higher pigment loadings permit the use of thinner photoconductive coatings. Thicknesses outside these ranges can be selected providing the objectives of the present invention are achieved.

Any suitable technique may be utilized to disperse the photoconductive particles in the binder and solvent of the coating composition. Typical dispersion techniques include, for example, ball milling, roll milling, milling in vertical attritors, sand milling, and the like. Typical milling times using a ball roll mill is between about 4 and about 6 days.

In embodiments, a charge transport layer may be deposited on the substrate. A charge transport solution may be formed by dissolving a charge transport material selected from compounds having in the main chain or the side chain a polycyclic aromatic ring such as anthracene, pyrene, phenanthrene, coronene, and the like, or a nitrogen-containing hetero ring such as indole, carbazole, oxazole, isoxazole, thiazole, imidazole, pyrazole, oxadiazole, pyrazoline, thiadiazole, triazole, and the like, and hydrazone compounds in a resin having a film-forming property. Such resins may include polycarbonate, polymethacrylates, polyarylate, polystyrene, polyester, polysulfone, styrene-acrylonitrile copolymer, styrene-methyl methacrylate copolymer, and the like. An illustrative charge transport solution has the following composition: 10% by weight N,N'-diphenyl-N,N'-bis(3-methylphenyl)-(1,1'-biphenyl)-4,4'diamine; 14% by weight poly(4,4'-diphenyl- 1,1'-cyclohexane carbonate) (400 molecular weight); 57% by weight tetrahydrofuran; and 19% by weight monochlorobenzene.

The substrate can be formulated entirely of an electrically conductive material, or it can be an insulating material having an electrically conductive surface. The substrate can be opaque or substantially transparent and can comprise numerous suitable materials having the desired mechanical properties. The entire substrate can comprise the same material as that in the electrically conductive surface or the electrically conductive surface can merely be a coating on the substrate. Any suitable electrically conductive material can be employed. Typical electrically conductive materials include metals like copper, brass, nickel, zinc, chromium, stainless steel; and conductive plastics and rubbers, aluminum, semitransparent aluminum, steel, cadmium, titanium, silver, gold, paper rendered conductive by the inclusion of a suitable material therein or through conditioning in a humid atmosphere to ensure the presence of sufficient water content to render the material conductive, indium, tin, metal oxides, including tin oxide and indium tin oxide, and the like. The substrate layer can vary in thickness over substantially wide ranges depending on the desired use of the photoconductive member. Generally, the conductive layer ranges in thickness from about 50 Angstroms to about 30 micrometers, although the thickness can be outside of this range. When a flexible electrophotographic imaging member is desired, the substrate thickness typically is from about 0.015 mm to about 0.15 mm. The substrate can be fabricated from any conventional material, including organic and inorganic materials. Typical substrate materials include insulating non-conducting materials such as various resins known for this purpose including polycarbonates, polyamides, polyurethanes, paper, glass, plastic, polyesters such as MYLAR® (available from DuPont) or MELINEX® 447 (available from ICI Americas, Inc.), and the like. If desired, a conductive substrate can be coated onto an insulating material. In addition, the substrate can comprise a metallized plastic, such as titanized or aluminized MYLAR®. The coated or uncoated substrate can be flexible or rigid, and can have any number of configurations such as a cylindrical drum, an endless flexible belt, and the like.

Any suitable technique may be utilized to apply each coating composition to the substrate to be coated. Typical coating techniques include dip coating, roll coating, spray coating, rotary atomizers, and the like. The coating techniques may use a wide concentration of solids. Preferably, the solids content is between about 2 percent by weight and 8 percent by weight based on the total weight of the dispersion. The expression "solids" refers to the photoconductive pigment particle and binder components of the coating dispersion. These solids concentrations are useful in dip coating, roll, spray coating, and the like. Generally, a more concentrated coating dispersion is preferred for roll coating.

Drying of the deposited coating may be effected by any suitable conventional technique such as oven drying, infrared radiation drying, air drying and the like. For example, after all the desired layers are coated onto the substrate, they may be subjected to elevated drying temperatures such as from about 100 to about 160° C. for about 0.2 to about 2 hours.

The invention will now be described in detail with respect to specific preferred embodiments thereof, it being understood that these examples are intended to be illustrative only and the invention is not intended to be limited to the materials, conditions, or process parameters recited herein. All percentages and parts are by weight unless otherwise indicated.

EXAMPLES

Four inventive coating compositions were made from a millbase by roll milling together Type II hydroxygallium phthalocyanine ("OHGaPc") as the pigment, cyclohexanone as the solvent, and BUTVAR® B-73 as the binder. There was a 60:40 pigment to binder ratio by weight and the solids concentration (pigment and binder) was 10% by weight of the millbase dispersion. The recipe for making the millbase composition consisted of roll milling 18 g of OHGaPc, 12 g of the binder polymer, i.e., B-73, 270 g of cyclohexanone and 300 ml of ⅛" steel shots in a 720 ml bottle for 5 days. The bottle was rolled on a two roller mill at 100 rpm speed. Four different coating dispersions, at 3 weight % of total solid, with four different pigment to binder ratios, 60:40, 50:50, 40:60 and 30:70, were prepared by adding different amount of B-73 polymer solution and cyclohexanone solvents into the millbase. The B-73 polymer solution was prepared by dissolving 10 grams of B-73 into 90 grams of cyclohexanone to make 10 weight % of polymer solution. To 10 grams of millbase, 23 grams of cyclohexanone was added to make 60:40 coating dispersion, 2 grams of B-73 polymer solution and 21 grams of cyclohexanone were added to make 50:50 dispersion, 5 rams of polymer solution and 18 grams of cyclohexanone were added to make 40:60 dispersion, 10 grams of polymer solution and 13 grams of cyclohexanone were added to make 30:70 dispersion.

Four multilayer photoreceptors were formed, each having an aluminum drum substrate, a blocking layer, a charge generating layer, and a charge transport layer. The drum substrates were 84 mm diameter and 300 mm long. To the aluminum substrates were applied the blocking layers. The blocking layers were formed at a thickness of 1.5 micrometer using Luckamide, a polyaminoamide manufactured by Dainippon Ink Co., Ltd. The blocking layers were formed by mixing the Luckamide with a suitable solvent and dip coating the Luckamide onto the substrate. The Luckamide blocking layers were dried at the 110° for 10 minutes.

Following the application of the blocking layers, charge generating layers were applied from the four different coating dispersions. The charge generating layers were applied by a Tsukiage ring coating method at a rate of 300 mm/min to the blocking layers. Th e generating layer coatings we re air dried without heating. The thickness of the charge generating layers was about 0.5 micrometers.

Charge transport layers were then applied over the charge generating layers. The charge transport layers were formed by coating upon the charge generating layers a 18 micron thickness layer of a solution of 60 parts by weight PCZ-400 (a polycarbonate resin available from Mitsubishi Gas Chemicals Co.) and 40 parts by weight of N,N'-diphenyl-N,N'-bis(3-methylphenyl)-(1,1'-biphenyl)-4,4'-diamine. The charge transport layers were applied by a dip coating process. The coatings were then dried at 110° C. for 20 minutes.

The photoreceptors were then tested for their electrical response characteristics using a cyclic scanner The drums were rotated at a constant surface speed of 5.66 cm per second. A direct current wire scrotron, narrow wavelength band exposure light, erase light and electrometer probes were mounted around the periphery of the mounted drums. The sample charging time was 177 milliseconds. The exposure light had an output wavelength of 780 nm and the erase light had a broad wavelength from 450 to 800 nm. The test samples were first rested in the dark for 10 minutes, then each sample was negatively charged in the dark to a potential around 360 V. The drum was then discharged by exposing the photoreceptor to the exposure light. The discharged surface potential was measured immediately after the exposure. The procedure was repeated with different exposure light intensities to obtain the photoinduced discharge characteristic of each sample device. The sensitivities, calculated from the rate of surface potential change as a function of exposure energy and the surface voltages after exposure to different amounts of light and erase light, are listed in Table 1. The sensitivities decreased as the pigment to binder ratio decreased. All the photoreceptors discharged to low voltages after exposure to the erase light.

TABLE 1

| Pigment/ binder ratio | $V_o$ | V at 3 ergs/cm$^2$ | V at 7 ergs/cm$^2$ | V at 25 ergs/cm$^2$ | V erase | DV/dX (V – cm$^2$/ ergs) |
|---|---|---|---|---|---|---|
| 60:40 | 361 | 60 | 45 | 35 | 25 | 272 |
| 50:50 | 361 | 86 | 56 | 38 | 23 | 226 |
| 40:60 | 345 | 93 | 61 | 40 | 21 | 222 |
| 30:70 | 343 | 163 | 118 | 78 | 33 | 126 |

The coating dispersions were measured with a controlled stress rheometer. After introducing coating dispersion to the double Couette cell of the rheometer, the test sample was placed in the cell for ten minutes to ensure that the sample reached equilibrium temperature, 25° C. The viscosity of the sample was measured under steady shear stress ramp on a log scale in 40 intervals varying from 0.07 Pa to 5 Pa.

The measurement results are summarized in the Table 2. All the coating dispersions were stable, with no yield point and over 0.9 power law numbers.

TABLE 2

| Pigment/binder ratio | Yield point | Power law | Viscosity (cp) |
|---|---|---|---|
| 60:40 | 0 | 0.947 | 9 |
| 50:50 | 0 | 0.972 | 11 |
| 40:60 | 0 | 0.961 | 9 |
| 30:70 | 0 | 0.928 | 15 |

EXAMPLE 2

Another photoreceptor was made and tested using the same procedures as discussed in Example 1 except that BUTVAR® B-72 was used. Similar results were obtained.

Other modifications of the present invention may occur to those skilled in the art based upon a reading of the present disclosure and these modifications are intended to be included within the scope of the present invention.

We claim:

1. A method for fabricating a photoreceptor comprising:

(a) preparing a first stable coating dispersion including a solvent, a first polymer, and a charge generating material; and (b) diluting the concentration of the charge generating material by adding an amount of a second polymer to the first stable coating dispersion without losing the dispersion stability thereof, thereby resulting in a second stable coating dispersion.

2. The method of claim 1, wherein the first polymer is the same as the second polymer.

3. The method of claim 1, further comprising: (c) depositing a layer of a charge generating composition on a substrate, wherein the charge generating composition is selected from the group consisting of the first stable coating dispersion and the second stable coating dispersion.

4. The method of claim 1, wherein the solvent includes cyclohexanone.

5. The method of claim 1, wherein the charge generating material is a phthalocyanine compound.

6. The method of claim 1, wherein the charge generating material is hydroxygallium phthalocyanine.

7. The method of claim 1, wherein first polymer and the second polymer include a polyvinyl butyral moiety, a polyvinyl alcohol moiety, and a polyvinyl acetate moiety, wherein the polyvinyl alcohol moiety has a hydroxyl content greater than about 17%, and wherein the first polymer and the second polymer have the same or different molecular weight of at least about 90,000.

8. The method of claim 7, wherein the first polymer and the second polymer have the same or different molecular weight ranging from about 90,000 to about 250,000.

9. The method of claim 7, wherein the polyvinyl alcohol moiety has a hydroxyl content ranging from about 17.5% to about 20%.

10. The method of claim 1, wherein the step (a) is accomplished by milling.

11. The method of claim 1, wherein the first stable coating dispersion and the second stable coating dispersion exhibit no yield point with a P value equal or larger than about 0.8 and a viscosity value equal or larger than about 4 centipoise.

* * * * *